US010368663B2

(12) United States Patent
Pinoli

(10) Patent No.: US 10,368,663 B2
(45) Date of Patent: Aug. 6, 2019

(54) PATCHWORK QUILT WITH FRAMED KEEPSAKES

(71) Applicant: Nancy Pinoli, Patterson, CA (US)

(72) Inventor: Nancy Pinoli, Patterson, CA (US)

( * ) Notice: Subject to any disclaimer, the term of this patent is extended or adjusted under 35 U.S.C. 154(b) by 489 days.

(21) Appl. No.: 14/181,898

(22) Filed: Feb. 17, 2014

(65) Prior Publication Data

US 2014/0283722 A1 Sep. 25, 2014

Related U.S. Application Data

(60) Provisional application No. 61/804,966, filed on Mar. 25, 2013.

(51) Int. Cl.
*A47G 9/02* (2006.01)
*D05B 97/12* (2006.01)

(52) U.S. Cl.
CPC ..... *A47G 9/0207* (2013.01); *D05B 97/12* (2013.01); *Y10T 442/2746* (2015.04)

(58) Field of Classification Search
CPC .... A47G 9/0207; A47G 9/0223; D05B 97/12; Y10T 442/2746
USPC ..... 434/97, 428, 429, 430
See application file for complete search history.

(56) References Cited

U.S. PATENT DOCUMENTS 3,582,993 A * 6/1971 Keller ..... A41D 1/22 2/74
4,395,964 A * 8/1983 Warren ..... D05B 97/12 112/441
4,949,415 A 8/1990 Selga
5,099,773 A * 3/1992 Codos ..... A41D 27/08 112/420
5,531,176 A * 7/1996 Johnson ..... D06Q 1/00 112/439
5,898,962 A 5/1999 McNeal
D411,401 S 6/1999 Edick et al.
5,943,698 A * 8/1999 Blanks, I ..... A41D 27/08 2/115
6,101,645 A * 8/2000 Hill ..... A47G 9/0253 5/482
D434,590 S 12/2000 Faulkender et al.
6,926,307 B2 * 8/2005 Mathews-Lingen ..... B42D 1/08 281/15.1
D517,361 S 3/2006 Friedman
7,107,638 B2 * 9/2006 Wilson ..... A47G 9/0207 5/482
7,380,298 B2 * 6/2008 Hernandez ..... A47G 9/1045 5/639
7,926,433 B2 4/2011 Preston
(Continued)

*Primary Examiner* — Nathan E Durham
(74) *Attorney, Agent, or Firm* — Global Intellectual Property Agency, LLC; Daniel Boudwin

(57) ABSTRACT

A blanket in the form of a patchwork quilt and a method of creation is provided. The quilt comprises a plurality of patchwork squares that are cut from a variety of cloth pieces. A plurality of fabric strips is cut to form the border of the patchwork square, whereby each strip comprises a heat-activated, dual-sided adhesive. The outer edges of the plurality of fabric strips are then sewn around the perimeter of the patchwork square, while the inner edge remains unsecured to the square. A keepsake may be inserted within the inner perimeter of the border, thereafter a user may secure the keepsake within the border by applying a heat source to the border.

3 Claims, 7 Drawing Sheets

(56) References Cited

U.S. PATENT DOCUMENTS

Figure 1:
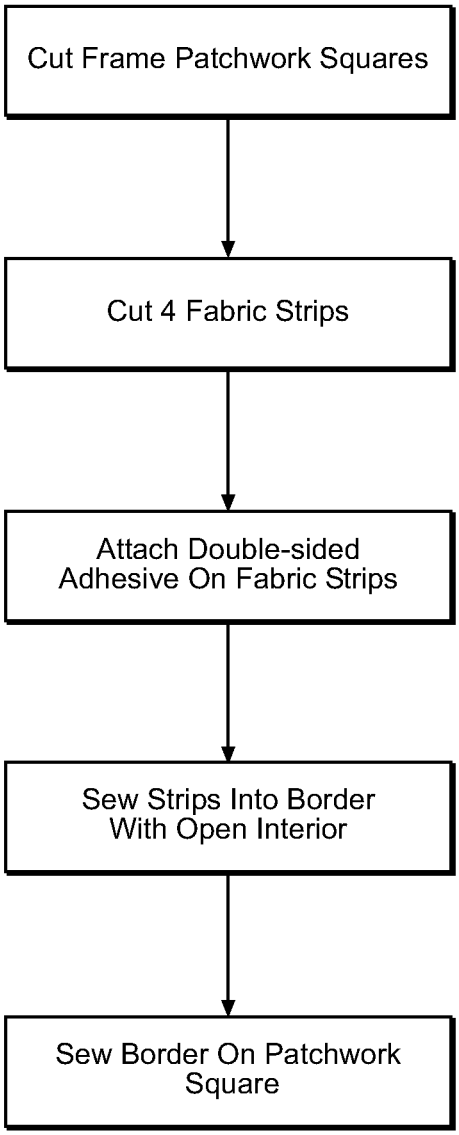

| | | | | |
|---|---|---|---|---|
| D662,750 | S | 7/2012 | Leask | |
| 2003/0150149 | A1* | 8/2003 | Quick | A63H 3/003 40/725 |
| 2007/0161511 | A1 | 7/2007 | Wyllie | |
| 2010/0083416 | A1* | 4/2010 | Curry | A41D 13/0012 2/51 |
| 2012/0073048 | A1* | 3/2012 | Ballard | A47G 9/062 5/485 |
| 2012/0301865 | A1* | 11/2012 | Taylor | G09B 3/00 434/365 |

* cited by examiner

PATCHWORK QUILT WITH FRAMED KEEPSAKES

CROSS REFERENCE TO RELATED APPLICATION

This application claims the benefit of U.S. Provisional Application No. 61/804,966 filed on Mar. 25, 2013, entitled "Memory Quilt". The above identified patent application is herein incorporated by reference in its entirety to provide continuity of disclosure.

BACKGROUND OF THE INVENTION

Field of the Invention

The present invention relates to a blanket. More specifically the invention relates to a quilt having sewn-in frames that can store a variety of items, such as photographs, clothing, or hand prints.

A quilt is a type of blanket that comprises an upper woven layer, an insulating layer, and a back piece. Quilts differ from other blankets in that they are typically comprised of a variety of fabrics that are stitched together to form a unified blanket.

A patchwork quilt is a type of blanket that is formed from a variety of pieces of cloths that are sewn together into a larger piece of artwork. These cloths may differ in color, texture, and size. The variety of pieces are sewn into a unified panel that forms a top layer of the quilt. A middle layer typically comprises an insulating layer, and a back piece secures the insulating layer between the upper unified panel of squares and the back piece.

A user may try to add a personal touch to the patchwork quilt by sewing keepsakes into the quilt. For example, a user may replace a traditional patchwork square with cutout from a sweater or T-shirt design. The method of placing keepsakes within the quilt has several drawbacks. First, each of the keepsakes must be meticulously measured and cut for placement into the quilt. Second, a user must sew in all keepsakes prior to the completion of the quilt.

There are several devices and methods in the prior art that attempt to provide blankets configured for the storage of keepsakes. These include devices that provide a pillow with viewing windows. These devices, however, fail to provide an adequate means for providing a keepsake within a completed patchwork quilt.

The present invention provides a patchwork quilt that is comprised of a plurality of patchwork squares. Each square comprises a perimeter border formed from a plurality of fabric strips. The strips each comprise a heat-activated, dual sided adhesive. The outer edges of the strips are machine sewn to the outer perimeter of the patchwork square, while the inner edges remain unsecured to the square. A user sews the plurality of squares into a unified panel to complete the quilt. Thereafter, a user may desire to insert a keepsake into one of the quilt square spaces. The user then obtains the keepsake, lifts the unsecured inner edge of the fabric strip, and inserts the keepsake within the border. The user then applies an iron to the fabric strips, thereby sealing the keepsake within the border of the patchwork square.

Description of the Prior Art

Devices have been disclosed in the prior art that relate to keepsake holders. These include devices that have been patented and published in patent application publications. These devices generally relate to blankets and pillows that comprise openings for the placement of keepsakes. The following is a list of devices deemed most relevant to the present disclosure, which are herein described for the purposes of highlighting and differentiating the unique aspects of the present invention, and further highlighting the drawbacks existing in the prior art.

One such prior art device, U.S. Pat. No. 4,949,415 to Selga provides a quilt that comprises greeting cards in the form of fabric patches. A user assembles a quilt with blank squares and sends the quilt to recipients who sew their own personal fabric patches into the quilt. The prior art device, however, fails to provide a border that may receive a keepsake therein.

Another prior art device, U.S. Pat. No. 7,926,433 to Preston provides a quilt blank method. The method comprises providing a quilt blank having a predetermined blank portion that is sized to receive a fabric swatch. The prior art device, however, also fails to provide a border for receiving a keepsake, and further fails to enable reception of a keepsake on a completed quilt.

Yet another prior art device, U.S. Pat. No. 5,898,962 to McNeal provides a pillow that comprises a plurality of photograph displays. The displays may be in the form of clear pockets that have an open upper end for receiving pictures therein. Although the prior art of McNeal is similar in nature and relevant to the present invention, it differs in that it fails to provide a securing border on a quilt.

Another prior art device, U.S. Patent Publication No. 2007/0161511 to Wyllie provides a laundry-safe photo blanket. The blanket comprises a plurality of photographs that are heat sealed onto the blanket. While the device is similar in nature to the present invention, it fails to provide a quilt with borders that are configured to receive the keepsake items.

Finally, there are a plurality of designs that are configured to retain keepsakes. These designs include U.S. Pat. No. D662,760 to Leask, U.S. Pat. No. D517,361 to Friedman, U.S. Pat. No. D411,401 to Edick, and U.S. Pat. No. D434,590 to Faulkender. The patents provide designs for pockets on quilts, holders on pillows, and numbered patterns for quilts. These patents each are valuable for their own uses, however, neither of these designs comprise a patchwork quilt having a border that is configured for holding keepsakes therein.

The present invention provides a patchwork quilt that is configured for retaining keepsake items. Each of the patchwork squares of the quilt comprises a border around its perimeter, whereby the inner edges of the borders are unsecured to the patchwork square. In use, a user may place a keepsake within the border of the patchwork square of the quilt. The user may then apply heat to the perimeter of the border to secure the keepsake within the border of the square.

In view of the drawbacks of the prior art devices, it is shown that the prior art has several known setbacks and that the present invention is substantially divergent in design elements from the prior art and subsequently it is clear that there is a need in the art for an improvement to existing patchwork quilts. In this regard the instant invention substantially fulfills these needs.

SUMMARY OF THE INVENTION

In view of the foregoing disadvantages inherent in the known types of blankets now present in the prior art, the present invention provides a new quilt having frames wherein the same can be utilized for providing convenience for the user when preservation of memories and keepsakes in a quilt are desired.

It is therefore an object of the present invention to provide a new and improved patchwork quilt that has all of the advantages of the prior art and none of the disadvantages.

It is another object of the present invention to provide a quilt that is capable of retaining a keepsake therein.

Another object of the present invention is to provide a patchwork quilt comprising squares, whereby each square is bordered by fabric strips.

Yet another object of the present invention is to provide fabric strips that comprise heat-activated dual sided adhesive, whereby the adhesive secures a keepsake within the border.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 displays a flow chart describing the steps of assembling the quilt patchwork squares.

Figure 2:
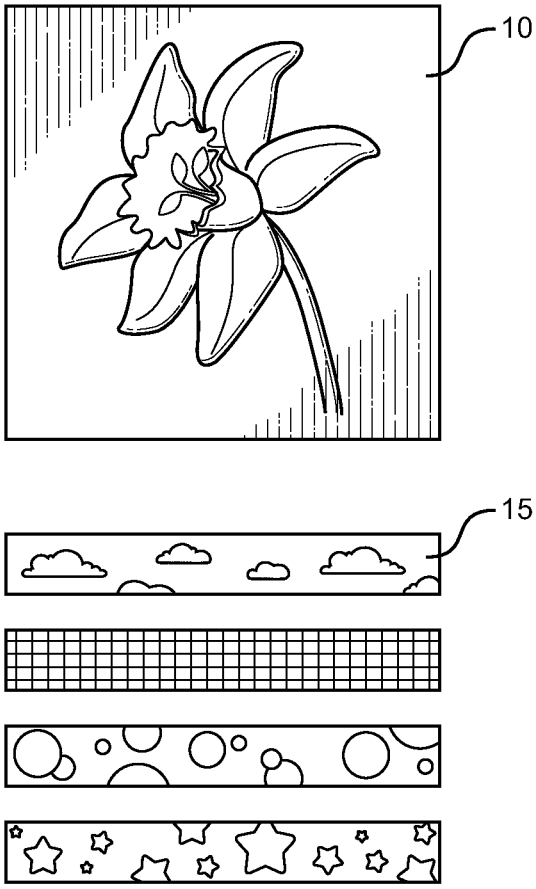

FIG. 2 displays a view of a quilt patchwork square and quilt border strips.

Figure 3:
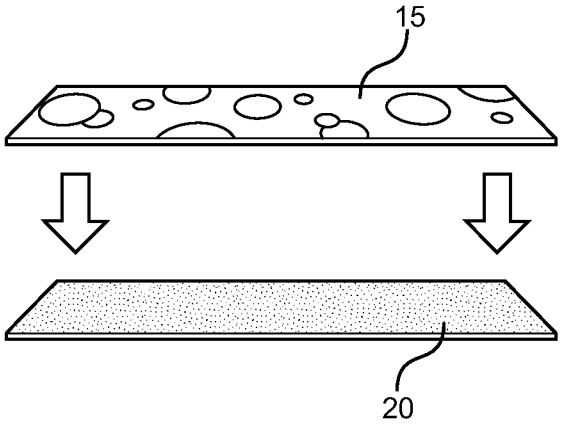

FIG. 3 displays a view of quilt border strips and dual sided adhesive tape.

Figure 4:
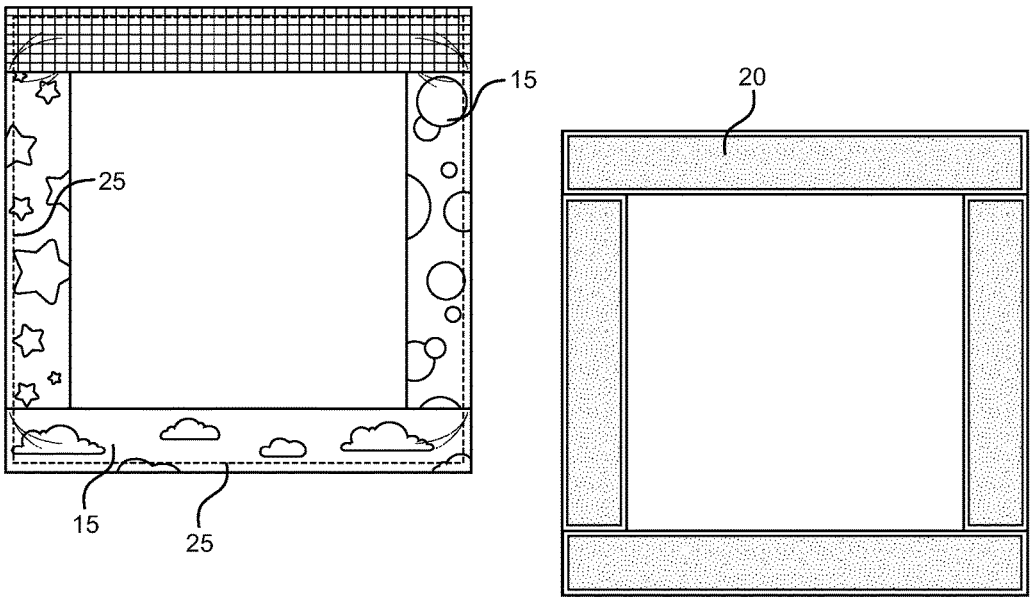

FIG. 4 displays front and back views of a completed quilt border.

Figure 5:
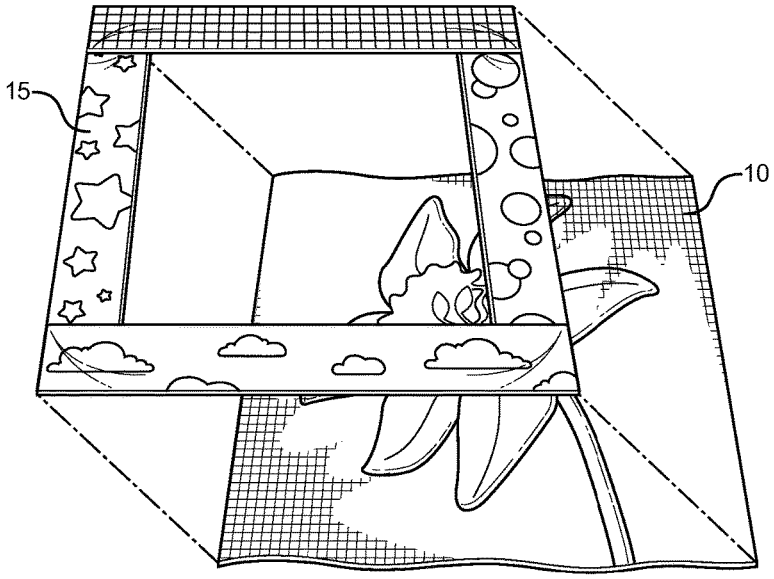

FIG. 5 displays a view of a quilt border applied onto a quilt square.

Figure 6:
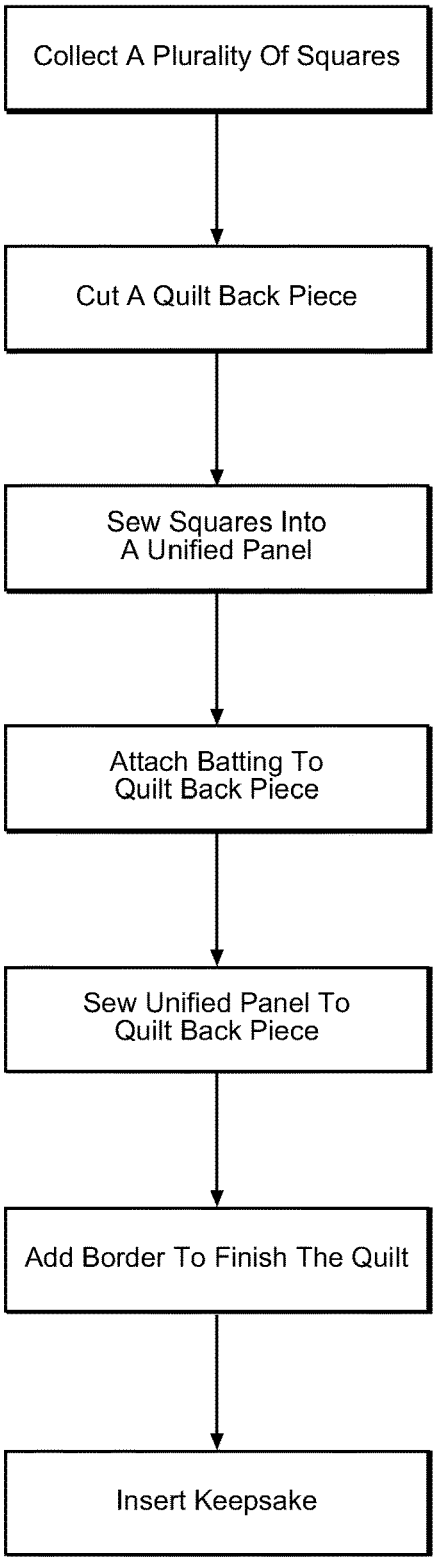

FIG. 6 displays a flow chart describing the assembly of the quilt.

Figure 7:
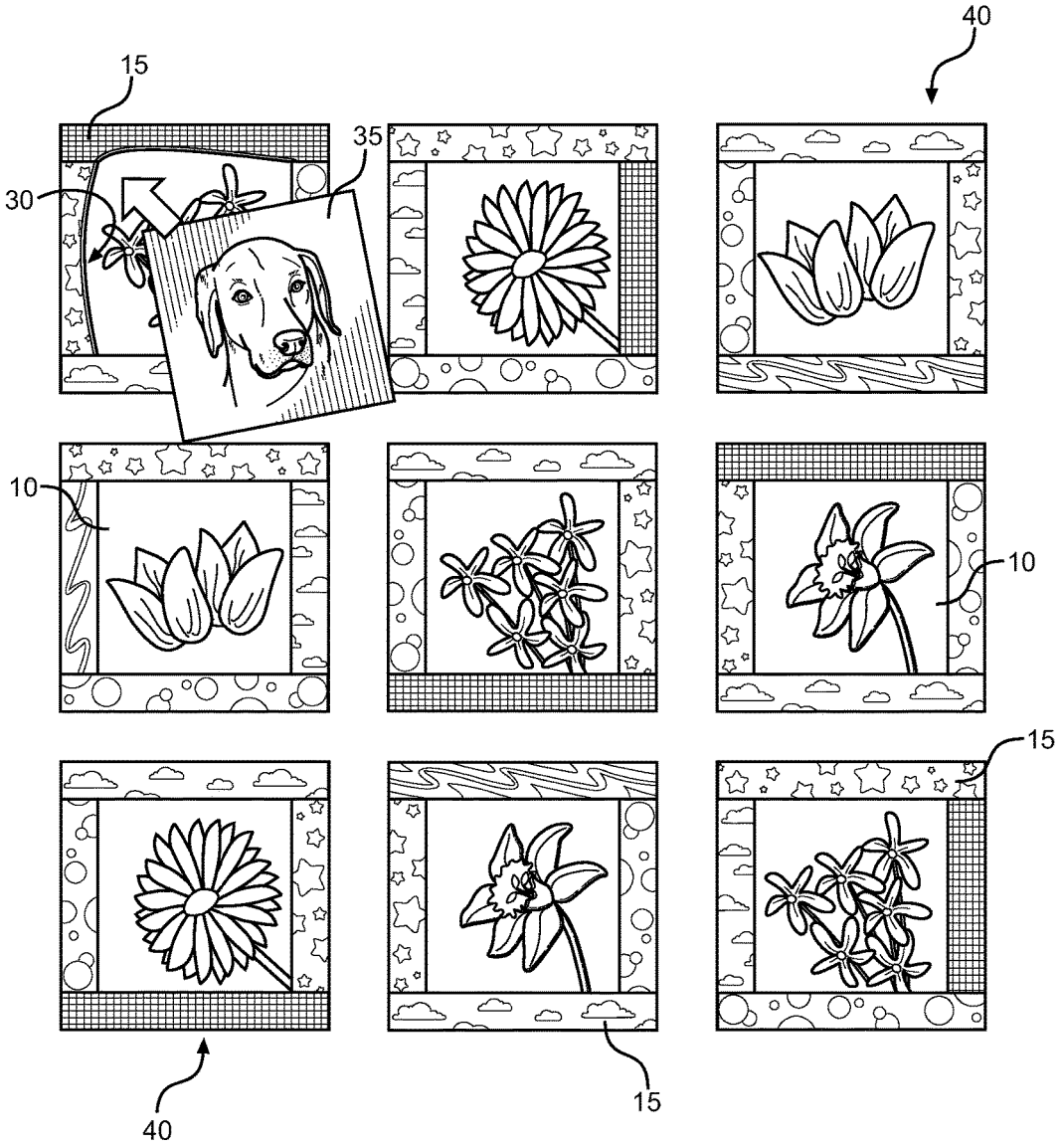

FIG. 7 displays a collection of a plurality of quilt squares with borders.

Figure 8:
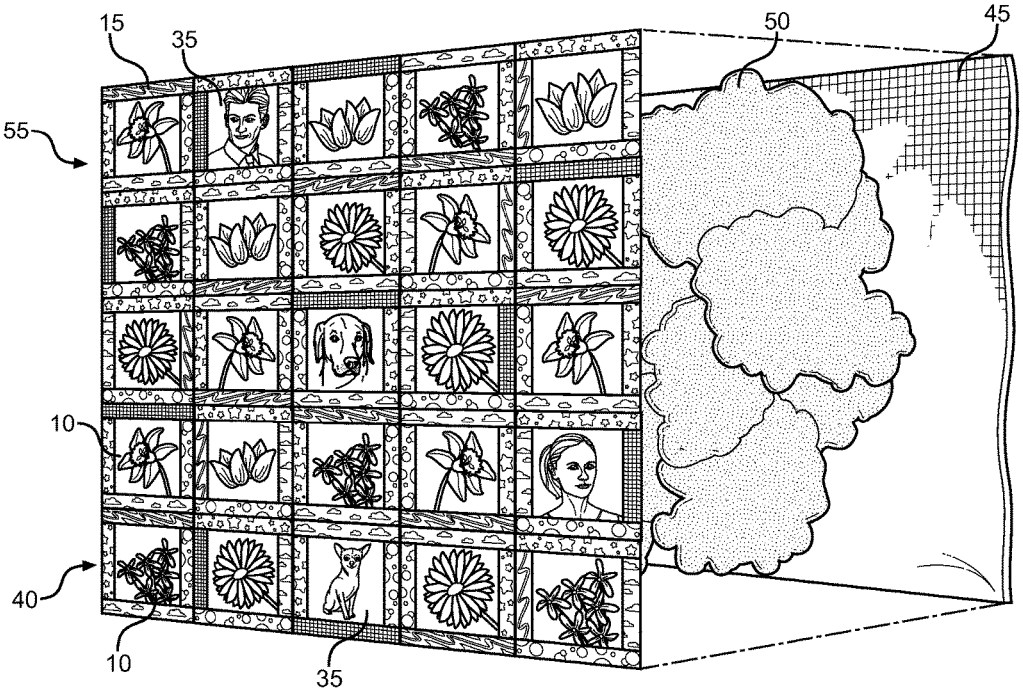

FIG. 8 displays a view of the assembled squares sewn together and being attached to a quilt backing.

Figure 9:
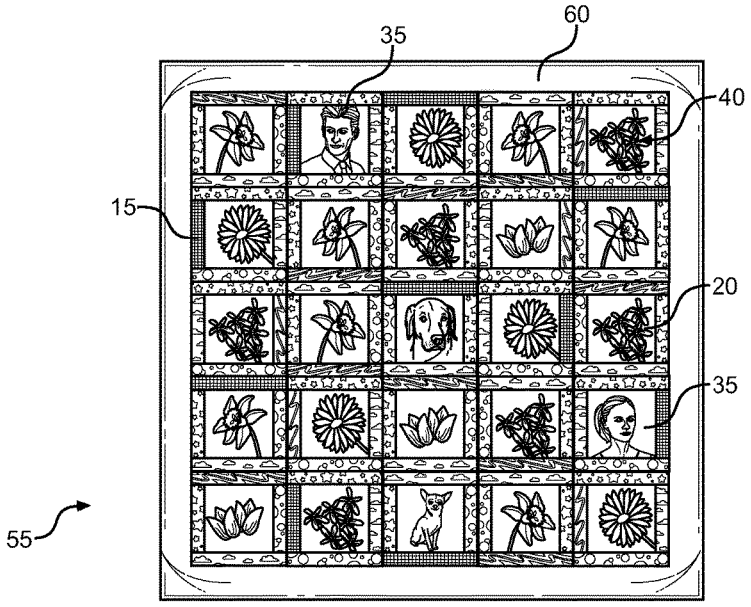

FIG. 9 displays a view of the quilt with an outer border.

Figure 10:
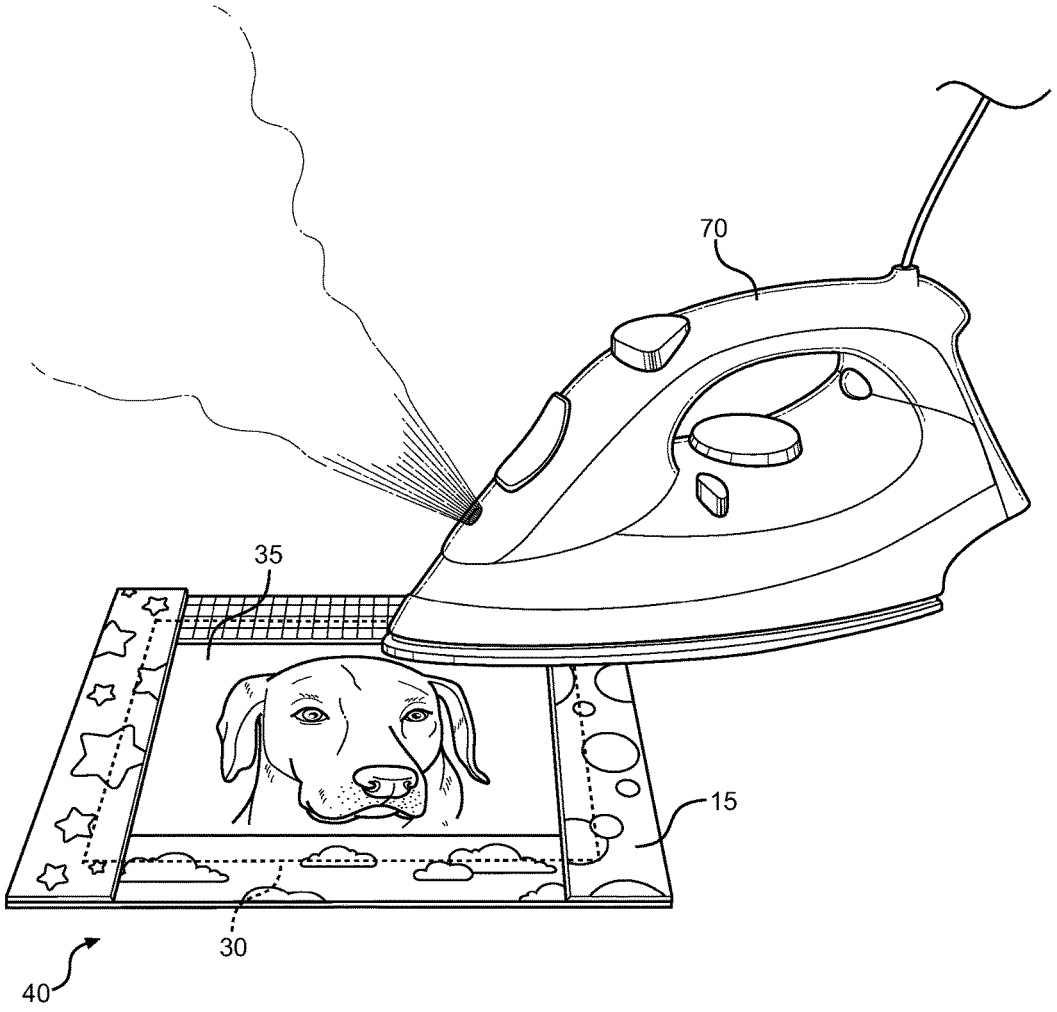

FIG. 10 displays a view of a decorative piece being secured into the quilt by ironing the border.

DETAILED DESCRIPTION OF THE INVENTION

Reference is made herein to the attached drawings. Like reference numerals are used throughout the drawings to depict like or similar elements of the quilt. For the purposes of presenting a brief and clear description of the present invention, the preferred embodiment will be discussed as used for preserving keepsakes and memories in a quilt. The figures are intended for representative purposes only and should not be considered to be limiting in any respect.

Referring now to FIG. 1, there is shown a flow chart indicating the method of assembling the quilt squares that form the quilted blanket of the present invention. The method comprises the steps of cutting patchwork squares, cutting fabric strips, applying adhesive to the strips, sewing the strips together, and securing the strips onto the patchwork square. The first step of collecting a plurality of patchwork squares may be cut from a variety of fabric types and designs. Preferably the squares are cut to the same dimensions. However, it is contemplated that the squares may be of different sizes, and alternatively they may comprise separate geometric shapes, such as triangular or circular shapes.

The second step comprises the cutting of a plurality of fabric strips that are configured to border the perimeter of each of the patchwork squares. In the preferred method, four strips are utilized to border the patchwork square. However, when different shapes are used there may be a differing amount of fabric strips needed to border the patchwork piece. The fabric strips may comprise different designs, colors, and fabric than that of the patchwork squares.

Referring now to FIG. 2, there is displayed a view of the patchwork square 10 and bordering fabric strips 15. The fabric strips 15 are cut and sized to cover the perimeter of the patchwork square 10. The strips 15 may each comprise different designs from one another, and more preferably, the designs each differ from the patchwork square 10. The square 10 may be comprised of a fabric that may include intricate or subtle designs, or alternatively may include a solid background to suit the aesthetic tastes of the user.

Referring now to FIG. 3, there is displayed the third step of forming the quilt square of the present invention, whereby the step comprises securing a dual sided adhesive 20 onto the fabric strip 15. The adhesive may be a heat activated, or iron on adhesive, that enables manipulation of the adhesive without becoming secured onto the fabric strip 15. The adhesive 20 is cut to the same dimensions of the fabric strip 15, thereby forming a dual sided adhesive strip that completely covers a side of the fabric without extending beyond the perimeter edges of the fabric strip 15. One side of the adhesive 20 is configured to cover the fabric strip 15, whereas the opposing side of the adhesive is exposed. The adhesive 20 is secured onto the back (non-decorative) side of the fabric strip 15 by the use of a sewing machine. The user may sew the perimeter of the fabric strip 15, thereby securing the two strips together.

Referring now to FIG. 4, there is displayed an image of step four of the flow chart of FIG. 1, whereby the step involves sewing the strips together in the shape of the perimeter of the patchwork square. In the preferred embodiment, four fabric strips 15 are cut from differing fabric patterns. The fabric strips 15 are sized to form a border around a patchwork square 10, and should cover the length of the square 10. Widthwise the strips 15 should only cover a small portion of the square 10, thereby enabling visibility of the designs of the patchwork square 10.

A collection of four strips 15 and adhesives 20 are secured to each other by the use of a sewing machine or other suitable securing means, thereby forming a border that is configured to cover the perimeter of the patchwork square 10 without extending beyond the perimeter of the square. The decorative sides of the fabric 15 is designed to be the upper surface of the border, whereas the opposing end with the exposed adhesive 20 is configured for contacting the perimeter of the patchwork square 10. Each of the strips 15 are secured to each other along the outer perimeters 25 of the strips 15. This is accomplished by following the initial sewing line that secured the dual sided adhesive 20 to the fabric strip 15 and continuing the sewing line over the width of the adjacent fabric strip, thereby securing the strips together.

Referring now to FIG. 5, there is displayed an image of the fifth step of the method of assembling a patchwork quilt square as indicated by FIG. 1. The figure illustrates the step of attaching the border formed by the assembly of the fabric strips 15 and dual-sided adhesives 20 to a patchwork square 10. The assembled fabric strips 15 are configured to cover the perimeter of the patchwork square 10. The patchwork square 10 is one in which may be cut from another product or another assembly, wherein the square 10 may include unfinished edges along its perimeter. The outer perimeter of the assembled strips 15 is secured to the outer perimeter of the patchwork square 10 by sewing the outer edges of the perimeters together. The inner perimeter of the assembled strips 15 remains unsecured to the patchwork square 10, thereby enabling limited movement of the inner perimeter of the fabric strips 15 relative to the patchwork square. The assembled strips 15, once applies, provide a border for the square 10, covering any unfinished edges and preventing any potential fraying thereof or general unsightliness.

Referring now to FIG. 6, there is displayed a flowchart indicating the steps to assemble the patchwork quilt of the present invention. The steps comprise collecting a plurality of patchwork squares, cutting a quilt back piece, sewing the squares together into a unified panel, attaching batting to the back piece, sewing the unified panel onto the quilt back piece, adding a border around the quilt, and inserting keepsakes within the individual borders of the patchwork squares.

Referring now to FIG. 7, there is displayed the first step of the flow chart of FIG. 6, whereby the image displays a plurality of completed patchwork squares, also known as quilt squares 40. The quilt squares 40 each comprise a border formed by securing frame strips 15 to dual sided adhesive strips 20. The assembled fabric strips 15 are machine sewn and secured onto a perimeter edge of the patchwork square 10. The inner perimeter 30 of the assembled strips 15 remains unsecured to the patchwork square 10, thereby providing an open interior portion that is capable of movement relative to the patchwork square 10. A keepsake 35 is capable of being secured within the inner perimeter edge 30 of the assembled strips 15 that border the patchwork square 10.

Referring now to FIG. 8, there is shown an illustration comprising steps 2-5 of FIG. 6, whereby the steps comprise cutting a quilt back piece, sewing squares into a unified panel, attaching batting to the quilt back piece, and securing the sections together. The plurality of quilt squares 40 that include borders 15 are organized in a side by side manner. First the ends of the squares 40 are sewn together in order to form a plurality of elongated strips of quilt squares. The sides of the elongated quilt squares strip are then secured to each other, thereby forming a unified panel 55 of quilt squares 40.

A quilt back piece 45 may be measured and cut from a fabric, whereby the back piece 45 is configured to comprise the same dimensions as the unified panel 55 of quilt squares 40. A cushioning layer 50 may be placed onto the unused (non-decorative) side of the quilt back piece 45. The cushioning 50 may be one or more of a batting, wadding, or other soft material. The quilt is assembled by aligning the back piece 45 and cushioning layer 50 with the unified panel 55 of quilt squares 40. The two sides are then secured to each other by machine sewing around the perimeter of the back piece 45 to the aligned perimeter of the unified panel 55 of quilt squares 40, thus securing the cushioning layer 50 between the unified panel 55 and quilt back piece 45.

Referring now to FIG. 9, there is displayed a view of the completed quilt, whereby the quilt perimeter comprises a finished border that is machine sewn around the perimeter of the unified panel and back piece. The border 60 serves to protect the edges of the quilt against becoming, ripped, torn, or frayed. Moreover, the border 60 provides an aesthetic perimeter that may be modified to suit the needs of the user.

Referring now to FIG. 10, there is displayed a view of a decorative keepsake being secured onto the quilt. The connected fabric strips 15 border around each quilt square 40. The non-decorative side of each of the fabric strips 15 comprises a dual sided heat-activated adhesive. The exterior edges of the fabric strips 15 are sewn onto the patchwork square, while the interior edge 30 of the strip 15 remains unsecured to the square. A user may secure a keepsake 35 into the quilt square 40 by lifting the interior side 30 of the fabric strip as displayed in FIG. 7. The user may then place the keepsake 35 within border. Next a user may apply heat 70 to the surface of the bordering fabric strips 15, with a focus on the unsecured edge 30 of the fabric strips 15. The heat-activated dual sided adhesives are then sealed onto the underside of the fabric strips 15 and the quilt square 40, thus securing the keepsake within the border of fabric strips 15. The process of securing a keepsake within the quilt may be performed prior to, or after unification of the quilt panel.

The present invention provides a new quilt having bordered patchwork squares. The quilt is comprised of a plurality of patchwork squares 10 cut from a variety of fabric designs. A user may then cut a plurality of fabric strips 15 that are configured to border the perimeter of the patchwork square 10. A heat-activated dual sided adhesive 20 is sewn onto the back of each fabric strip 15. The fabric strip 15 and adhesive 20 may then be sewn onto the outer perimeter of the patchwork square 10, whereby the inner side 30 of the fabric strips 15 remain unsecured to the square 10. The plurality of patchwork squares 10 with bordering fabric strips 15 form quilt squares 40 that may be sewn into a unified panel 55. The unified panel 55 may then be secured onto a quilt back piece 45. A user may then secure a keepsake 35 within the border of the quilt square 40 by heat sealing the desired keepsake 35 within the border by ironing 70 the surface of the fabric strips 15.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for creating quilt squares, comprising:

cutting a plurality of patchwork squares from a variety of fabric designs;

arranging fabric strips to border a perimeter of each of said patchwork squares;

sewing a dual sided adhesive directly onto the back of each of said fabric strips;

sewing said fabric strips together in a shape of said patchwork square perimeter;

securing said frame strips to an outer perimeter of said patchwork square, whereby an entire inner perimeter edge of said fabric strips remain unsecured onto said patchwork square forming an open window;

wherein at least one side of the entire inner perimeter edge of said fabric strips receives a perimeter edge of a keepsake therein and removable secures said keepsake thereto.

2. The method of claim 1, further comprising heating said adhesive, whereby said heated adhesive seals said keepsake within said fabric strip border.

3. A method for creating quilt squares, comprising:

cutting a plurality of patchwork squares from a variety of fabric designs;

arranging fabric strips to border a perimeter of each of said patchwork squares;

sewing a dual sided adhesive directly onto the back of each of said fabric strips;

sewing said fabric strips together in a shape of said patchwork square perimeter;

securing said frame strips to an outer perimeter of said patchwork square, whereby an entire inner perimeter edge of said fabric strips remain unsecured onto said patchwork square forming an open window;

wherein at least one side of the entire inner perimeter edge of said fabric strips receives a perimeter edge of a keepsake therein and removable secures said keepsake thereto cutting a quilt backing piece, whereby the said quilt backing piece equals a dimension of a unified panel, wherein the unified panel comprises the plurality of patchwork squares;

attaching a padding to said quilt backing piece;

securing said quilt backing piece to said unified panel;

securing a border around a perimeter of said unified panel and the quilt backing piece.

* * * * *